US010787823B2

(12) United States Patent
Lavallie et al.

(10) Patent No.: US 10,787,823 B2
(45) Date of Patent: Sep. 29, 2020

(54) METHOD FOR PRODUCING A FLASH COVING PROFILE AND METHOD FOR ARRANGING THE OBTAINED FLASH COVING PROFILE IN THE CORNER BETWEEN A FLOOR AND A WALL

(71) Applicant: Forbo Flooring B.V., Assendelft (NL)

(72) Inventors: Danny Dennis Lavallie, Ottawa (CA); Johnny Kontosic, Caledon (CA)

(73) Assignee: Forbo Flooring B.V., Assendelft (NL)

( * ) Notice: Subject to any disclaimer, the term of this patent is extended or adjusted under 35 U.S.C. 154(b) by 0 days.

(21) Appl. No.: 16/675,457

(22) Filed: Nov. 6, 2019

(65) Prior Publication Data

US 2020/0141133 A1 May 7, 2020

(30) Foreign Application Priority Data

Nov. 7, 2018 (NL) ..... 2021953

(51) Int. Cl.
*E04F 19/04* (2006.01)
*E04F 19/06* (2006.01)

(52) U.S. Cl.
CPC ..... *E04F 19/04* (2013.01); *E04F 19/061* (2013.01); *E04F 2019/0413* (2013.01)

(58) Field of Classification Search
CPC ..... E04F 19/061; E04F 19/0481; E04F 2019/0413; E04F 19/04
See application file for complete search history.

(56) References Cited

U.S. PATENT DOCUMENTS 2,069,289 A 2/1937 Swendsen et al.
2,994,905 A * 8/1961 Franker, Jr. ..... E04F 19/0495 52/273
3,549,471 A * 12/1970 Denton ..... E04F 19/061 428/188
3,739,423 A * 6/1973 Denton ..... A47G 27/0456 16/16
4,706,427 A * 11/1987 Zeilinger ..... A47K 3/001 52/287.1
5,010,703 A * 4/1991 Pearlman ..... A47G 27/0456 52/273
10,125,501 B2 * 11/2018 Rossi ..... E04F 19/0481
2006/0185295 A1 * 8/2006 Gardner ..... A47G 27/0456 52/469

(Continued)

FOREIGN PATENT DOCUMENTS

GB 661025 11/1951

*Primary Examiner* — Andrew J Triggs
(74) *Attorney, Agent, or Firm* — The Webb Law Firm

(57) ABSTRACT

The invention relates to a method for producing a flash coving profile, including the steps of: providing an elongate metal sheet with a first longitudinal edge and a second edge opposing, and preferably parallel to, the first edge; adhering a flexible and preferably resilient flooring to a first face of the metal sheet, the flooring extending from the first edge to at least the second edge; and bending a cove into the metal sheet with the flooring adhered to it along a bend line which is parallel to and spaced apart from the first edge and on the side to which the flooring is adhered. The invention further relates to a method for arranging a flash coving profile obtained by the method according to the invention in the corner between a floor and a wall.

8 Claims, 2 Drawing Sheets

(56) References Cited

U.S. PATENT DOCUMENTS

| | | | | |
|---|---|---|---|---|
| 2008/0245006 | A1* | 10/2008 | Rachak | E04F 19/04<br>52/287.1 |
| 2017/0183879 | A1* | 6/2017 | Rossi | E04F 19/061 |
| 2020/0141133 | A1* | 5/2020 | Lavallie | E04F 19/045 |

* cited by examiner

METHOD FOR PRODUCING A FLASH COVING PROFILE AND METHOD FOR ARRANGING THE OBTAINED FLASH COVING PROFILE IN THE CORNER BETWEEN A FLOOR AND A WALL

CROSS-REFERENCE TO RELATED APPLICATION

This application claims priority to The Netherlands Patent Application No. 2021953 filed Nov. 7, 2018, the disclosure of which is hereby incorporated by reference in its entirety.

BACKGROUND OF THE INVENTION

Field of the Invention

The invention relates to a method for producing a flash coving profile.

Description of Related Art

For different applications, it is common to apply a flexible flooring such as resilient flooring to a subfloor. Typically, it is not desirable to use the same flooring to cover the entire adjacent wall, but still it is beneficial to create a smooth transition between the subfloor and the wall which is less likely to collect dust. To this purpose, it is known to flash cove the flooring up to the wall.

Traditionally, when flash coving, an upside-down U-shaped cove cap is fixed to the wall (e.g. with adhesive tape or contact cement) and a flexible vinyl or metal fillet-shaped cove former strip is arranged between the cove cap and the subfloor at the junction of the floor and the wall, after which a resilient layer is formed towards to the cove former and fixed to the cove cap. The main flooring may be installed either before or after flash coving. Both procedures have the disadvantage of being complex, requiring specialized installation skills. Furthermore, the cove former strip or the flooring may be damaged by pressing the flooring to hard against the cove former strip in the corner.

In other solutions, the fillet-shaped cove former strip is adhered to the back of the flooring and by that integrated with the flooring or, as an alternative, formed by reinforcing the backing of the flooring, thereby decreasing the number of steps necessary for installation. However, in such cases, the fixed position of the pre-installed cove cap limits the flexibility in fitting the cove former strip and furthermore increases the risk of misalignment of the cove former strip between the pre-installed cove cap and the pre-installed main flooring.

U.S. Pat. No. 2,994,905 A discloses another method for installing a flash cove. In this method, the fillet-shaped cove former and the cove cap are integrated in a single unit, to which the flooring layer is applied afterwards. The production of this flash coving profile is relatively costly due to the complex shape of the profile.

It is therefore an object of the invention to alleviate or even obviate the above-mentioned disadvantages.

SUMMARY OF THE INVENTION

This object is achieved with a method for producing a flash coving profile, comprising the steps of:

providing an elongate metal sheet with a first longitudinal edge and a second edge opposing, and preferably parallel to, the first edge;

adhering a flexible and preferably resilient flooring to a first face of the metal sheet, the flooring extending from the first edge to at least the second edge; and bending a cove into the metal sheet with the flooring adhered to it along a bend line which is parallel to and spaced apart from the first edge and on the side to which the flooring is adhered.

In the invention, the fillet-shaped cove former (made of a metal sheet) is provided with a layer of flexible and preferably resilient flooring to a first face of the metal sheet after which this combination is bent into a cove before adhering the flash coving profile to the wall. This increases the ease of production of the flash coving profile, which is substantially L-shaped and has a first section or leg to be adhered to a wall and a second section or leg to be adhered to a subfloor. The cove is preferably bent into the metal sheet by roller forming.

The bend line is on the side to which the flooring is adhered, which causes the first and second edge to lay closer to each other after bending when seen from the side of the profile to which the flooring is adhered.

The flooring will typically cover the entire first face, while the opposing second face of the metal sheet is free from covering or other material, allowing the metal sheet to be adhered directly to a subfloor and wall. The metal sheet is typically an aluminum sheet. Typically the length of the first edge ranges from 2.4 to 3.7 meters, while the width or distance between the first and second edge is typically approximately 200 millimeters. Typical examples of floorings are vinyl, linoleum, nylon 6,6 (preferably embodied as in the product Flotex, which is sold by the applicant) or rubber.

In a first embodiment of the method for producing a flash coving profile, the flooring extends beyond the second edge, preferably over a width of 50 to 150 mm perpendicular to the first edge.

In this way, it is easier to connect the flooring adhered to the coving profile to a further (main) flooring which covers the floor and which is typically of the same material as the flooring adhered to the metal profile. In installation of the coving profile in the corner between a wall and a floor, the additional amount of flooring which protrudes from the second edge can be arranged to slope towards and abut against the main flooring, in order to accommodate for height differences between the flooring of the flash coving profile and the further flooring. This protruding part is preferably fixed in this position upon installation by merely creating a sloping layer of leveling adhesive, therefore eliminating the need for a leveler strip.

A protrusion with a width of less than 50 mm will be too short for most purposes to bridge height differences between the coving profile and the further flooring, whereas a protrusion of more than 150 mm will make the flash coving profile unnecessarily large for most purposes.

In a second embodiment of the method for producing a flash coving profile, the method further comprises the step of arranging a self-adhesive strip on the second face of the metal sheet along the first edge.

The arrangement of a self-adhesive strip, preferably provided with a removable protective foil in order to prevent preliminary adhesion, allows the flash coving profile produced to be fixed fast, without requiring screws or nails. Typically the flash coving profile produced is, when it is applied in the corner between a wall and a subfloor, in addition to the self-adhesive strip, adhered with a main adhesive layer which hardens out over time. The main adhesive layer is typically applied to the wall and floor.

During the period required for hardening of the main adhesive, the self-adhesive strip will avoid the flash coving profile from releasing.

In a third embodiment of the method for producing a flash coving profile, the method further comprises the step of folding a zone of the elongate metal sheet adjacent to the first edge into a cove cap having a substantially U-shaped cross-section.

Although it is possible to provide a separate cove cap which is connected to the flash coving profile, it is preferred to fold a zone of the elongate metal sheet adjacent to the first edge into a cove cap, as this decreases the number of steps for obtaining a cove. In this embodiment, the metal sheet thus comprises a zone to be folded into the cove cap, which extends beyond the first edge.

Folding can be carried out by roller folding or angle bending. Extrusion is however an alternative way of obtaining a cove cap which should also be considered part of the scope of the invention.

In a fourth embodiment of the method for producing a flash coving profile, the zone is folded into a cove cap before adhering the flooring to the sheet.

Folding the zone into a cove cap before adhesion of the flooring to the metal sheet avoids the unintentional creation of folds in the flooring near the cove cap which may occur while folding the zone into a cove cap, when the flooring would have been already adhered.

In a fifth embodiment of the method for producing a flash coving profile, the method further comprises the steps of finishing the cove cap, comprising steps such as anodizing, lacquering or providing a cover layer.

In order to match aesthetical demands, the cove cap may be finished. Typical ways of finishing are anodization, lacquering or covering the cove cap with a cover layer with a decorative print. All of these steps may be performed before arranging the flash coving in the corner between a floor and wall.

The invention further relates to a method for arranging a flash coving profile in the corner between a floor and a wall, comprising the steps of:

providing a flash coving profile obtained by the method for producing a flash coving profile according to the invention, wherein the flash coving profile has a first section extending between the first edge and the cove and has a second section extending between the second edge and the cove;

adhering the first section of the flash coving profile to the wall;

adhering the second section of the flash coving profile to the floor; and providing a further flexible and preferably resilient flooring to the floor abutting the flooring of the flash coving profile, preferably after the step of adhering the second section of the flash coving profile to the floor.

In this method, it is preferred to first arrange and fix the flash coving profile according to the invention in the corner between a wall and a floor before the provision of the further flooring. This increases the ease of creation of an abutting connection between the flooring adhered of the coving profile and the further flooring.

In an embodiment of the method for arranging a flash coving profile, the method further comprises the step of welding the flooring of the flash coving profile to the further flooring.

The provision of a weld between the flooring of the flash coving profile and the further flooring creates a watertight and visually seamless connection between these parts.

BRIEF DESCRIPTION OF THE DRAWINGS

These and other aspects of the invention are further elucidated in the following drawings.

DESCRIPTION OF THE INVENTION

Figure 1A:
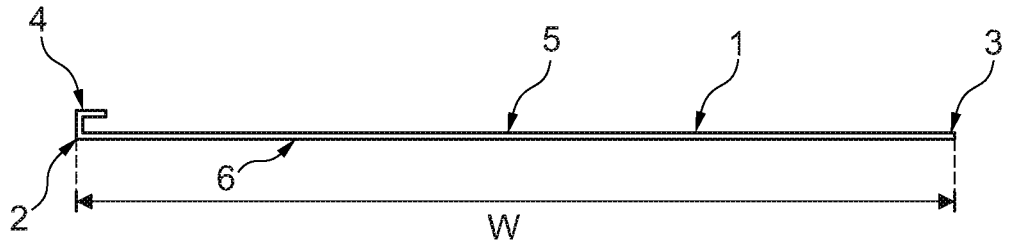
FIGS. 1A to 1C shows the steps of producing a flash coving profile according to the invention.
Figure 1B:
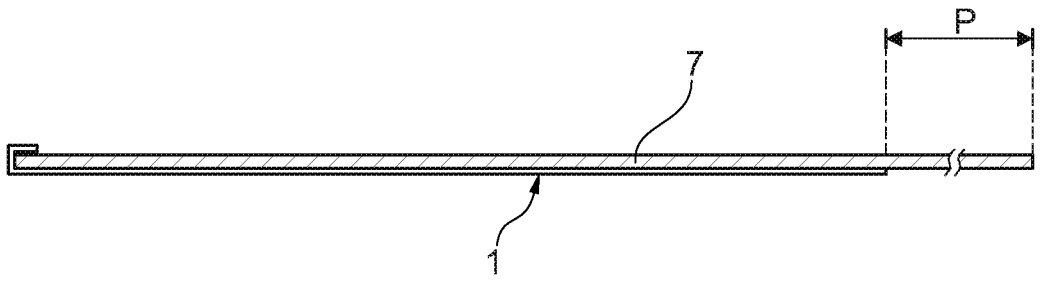
Figure 1C:
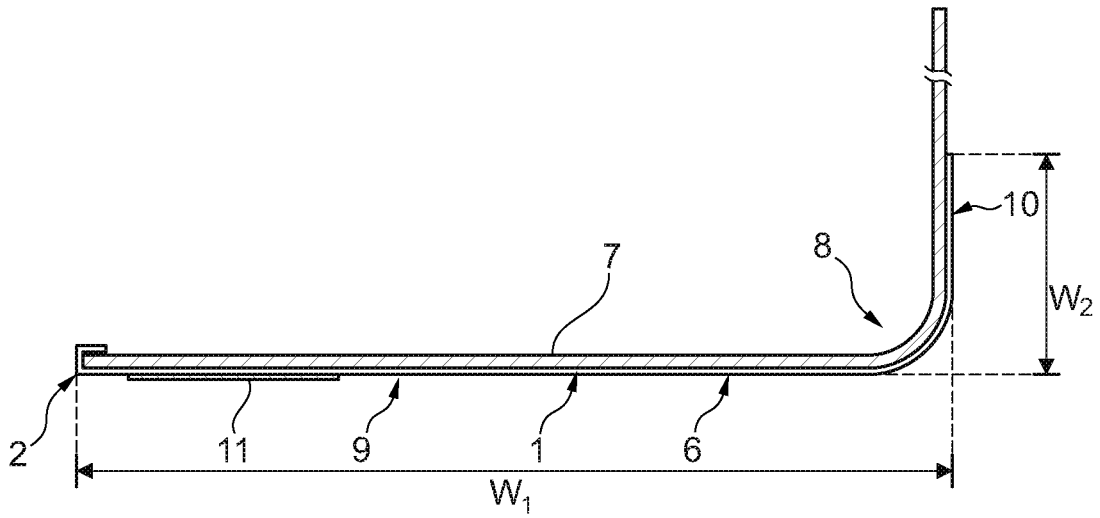
Figure 2:
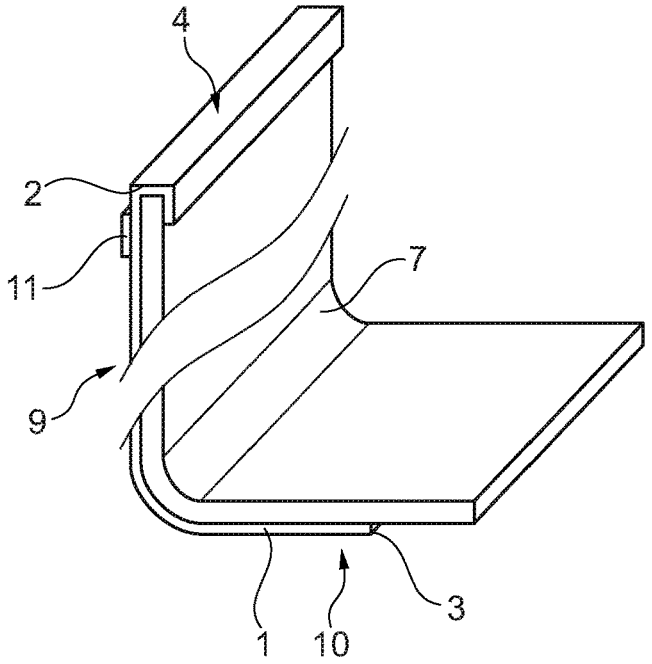
FIG. 2 shows a perspective view of the obtained flash coving profile.

The method for forming a flash coving profile according to the invention is disclosed in FIG. 1. The method starts, as shown in FIG. 1A, with a metal sheet 1 with a first edge 2 and a second edge 3, with a width W of approximately 200 millimeters. The length of the sheet 1, which runs perpendicular to the plane of the drawing, is typically between 2.4 and 3.7 meters. A zone adjacent to the first edge 2 is folded into a U-shaped cove cap 4. The metal sheet has a first face 5 and an opposing second face 6. Then, a layer of flooring 7 is adhered to the first face 5 of the metal sheet 1, protruding from the second edge 3 to a width P of between 50 and 150 millimeters. After that, a cove 8 with a radius of 12 to 26 millimeter is bent into the metal sheet along a bend line parallel to the first edge 2 and second edge 3, to obtain an L-shaped coving profile which has a first section 9 extending from the first edge to the cove 8, to be adhered to a wall, and a second section 10 extending from the second edge 3 to the cove 8, to be adhered to a subfloor. The width $W_1$ is typically around four times larger than the width $W_2$. Also, a self-adhesive strip 11 is arranged on the second face 6 of the metal sheet 1 close to the first edge 2. The obtained profile is also shown in FIG. 2.

Figure 3:
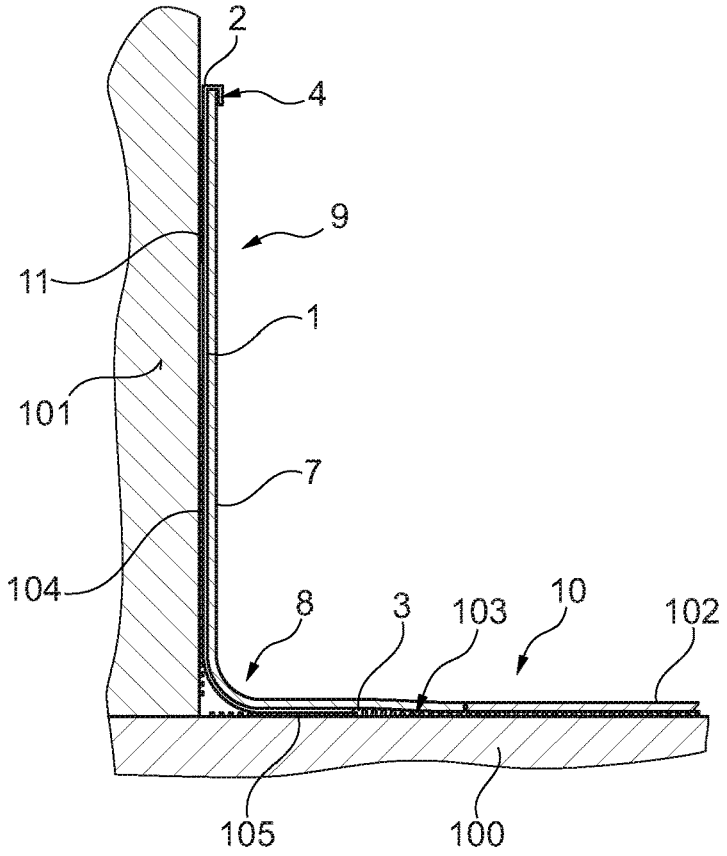
FIG. 3 shows a flash coving profile according to the invention installed in the corner between a wall and a floor.

FIG. 3 shows the profile installed in the corner between a subfloor 100 and a wall 101. The main flooring 102 abuts against the flooring layer 7 and is installed net fit or is welded to layer 7. The difference in thickness between the further flooring 102 and the flooring 7 which is arranged on the metal sheet 1 is accompanied for by a leveling adhesive layer 103 sloping towards the further flooring 102. It should be noted that the profile is, in addition to the self-adhesive strip 11, adhered to the floor 100 and wall 101 with layers of adhesive 104, 105 which are applied to the subfloor 100 and wall 101 before positioning the profile in the corner.

The invention claimed is:

1. A method for producing a flash coving profile, comprising the steps of:

providing an elongate metal sheet with a first longitudinal edge and a second edge opposing, and preferably parallel to, the first edge;

adhering a flexible and preferably resilient flooring to a first face of the metal sheet, the flooring extending from the first edge to at least the second edge; and bending a cove into the metal sheet with the flooring adhered to it along a bend line which is parallel to and spaced apart from the first edge and on the side to which the flooring is adhered.

2. The method according to claim 1, wherein the flooring extends beyond the second edge, preferably over a width of 50 to 150 mm perpendicular to the first edge.

3. The method according to claim 1, further comprising the step of arranging a self-adhesive strip on second face of the metal sheet along the first edge.

4. The method according to claim 1, further comprising the step of folding a zone of the elongate metal sheet adjacent to the first edge into a cove cap having a substantially U-shaped cross-section.

5. The method according to claim 4, wherein the zone is folded into a cove cap before adhering the flooring to the sheet.

6. The method according to claim 4, further comprising the step of finishing the cove cap, comprising steps such as anodizing, lacquering or providing a cover layer.

7. A method for arranging a flash coving profile in the corner between a floor and a wall, comprising the steps of:

providing a flash coving profile obtained by the method according to claim 1, wherein the flash coving profile has a first section extending between the first edge and the cove and has a second section extending between the second edge and the cove;

adhering the first section of the flash coving profile to the wall;

adhering the second section of the flash coving profile to the floor; and providing a further flexible and preferably resilient flooring to the floor abutting the flooring of the flash coving profile, preferably after the step of adhering the second section of the flash coving profile to the floor.

8. The method according to claim 7, further comprising the step of welding the flooring of the flash coving profile to the further flooring.

* * * * *